US012644207B2

(12) United States Patent
Bhatnagar

(10) Patent No.: US 12,644,207 B2
(45) Date of Patent: Jun. 2, 2026

(54) PLIED YARNS CONSTRUCTED FROM DIFFERENT FIBER TYPES AND METHODS OF FORMING THE PLIED YARNS

(71) Applicant: Target Brands, Inc., Minneapolis, MN (US)

(72) Inventor: Avinash S. Bhatnagar, Apple Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 19/076,155

(22) Filed: Mar. 11, 2025

(65) Prior Publication Data

US 2025/0305188 A1 Oct. 2, 2025

Related U.S. Application Data

(60) Provisional application No. 63/571,572, filed on Mar. 29, 2024.

(51) Int. Cl.
*D02G 3/04* (2006.01)
*D02G 3/28* (2006.01)

(52) U.S. Cl.
CPC ..... *D02G 3/04* (2013.01); *D02G 3/28* (2013.01); *D10B 2201/02* (2013.01); *D10B 2201/20* (2013.01); *D10B 2501/04* (2013.01); *D10B 2509/026* (2013.01)

(58) Field of Classification Search
CPC ..... D02G 3/04; D02G 3/28
See application file for complete search history.

(56) References Cited

U.S. PATENT DOCUMENTS 3,206,923 A * 9/1965 Price ..... D02G 3/441 338/214
6,775,970 B2 * 8/2004 Fernandez ..... D02G 3/285 57/58.36
7,690,180 B2 * 4/2010 Hegan, Jr. ..... D02G 3/46 57/238
7,810,308 B2 * 10/2010 Wang ..... D06B 3/10 57/283
2003/0200739 A1 * 10/2003 Fernandez ..... D02G 3/285 57/58.36
2018/0347080 A1 * 12/2018 Goenka ..... D03D 15/54
2019/0257011 A1 * 8/2019 Goenka ..... D03D 27/08
2022/0064827 A1 * 3/2022 Wang ..... D01H 13/04

FOREIGN PATENT DOCUMENTS

CN 116288838 A * 6/2023 ..... D02G 3/02
KR 20050097256 A * 10/2005 ..... D01H 5/58
KR 20080090181 A * 10/2008 ..... D02G 3/36
KR 20120071870 A * 7/2012 ..... D02G 3/28
KR 101388786 B1 * 4/2014 ..... D02G 3/04

OTHER PUBLICATIONS

Translation KR 101388786.*
Translation KR 20120071870.*
Translation KR 20050097256.*
Translation KR 20080090181.*
Translation CN 116288838.*

* cited by examiner

*Primary Examiner* — Shaun R Hurley
(74) *Attorney, Agent, or Firm* — Amanda M. Prose; Westman, Champlin & Koehler, P.A.

(57) ABSTRACT

Plied yarns and methods of constructing plied yarns from two different yarns, manufactured using different fibers wherein the plied yarns possess enhanced properties. The yarns developed and described herein are plied yarns, rather than, and in direct contrast to intimately blended yarns. Examples of the fibers and/or yarns utilized in forming the yarns of different fibers described herein, include but are not limited to 100% cotton, Modal, and Lyocell. The yarns described herein can be used for various end uses, including but not limited to formation of terry fabric for use in towels, robes, apparel, and the like.

16 Claims, No Drawings

PLIED YARNS CONSTRUCTED FROM DIFFERENT FIBER TYPES AND METHODS OF FORMING THE PLIED YARNS

CROSS-REFERENCE TO RELATED APPLICATION

The present application is based on and claims the benefit of U.S. provisional patent application Ser. No. 63/571,572, filed Mar. 29, 2024, the content of which is hereby incorporated by reference in its entirety.

BACKGROUND

Terry cloth or fabric is a textile product defined by surface loops on the fabric. These loops are formed by pile warp of yarn during the designing of products formed with terry cloth or fabric. These loops are further formed with different heights by maintaining the pile ratio to provide extra length in relation to the length of fabric. For example, the pile ratio of 6:1 will mean that 6 cm of pile warp is used to create 1 cm of linear fabric.

The most common uses of terry fabric include towels and other bath products such as bathrobes, kitchen towels and other accessories requiring high absorbency and low linting as well as various clothing items.

The discussion above is merely provided for general background information and is not intended to be used as an aid in determining the scope of the claimed subject matter. The claimed subject matter is not limited to implementations that solve any or all disadvantages noted in the background.

SUMMARY

An aspect of the present disclosure relates to a plied yarn formed with two different yarns, wherein a first yarn comprises 100% cotton or combed cotton fibers, and a second yarn comprises Modal or Lyocell fibers and wherein the first yarn and the second yarn are plied and are not intimately blended, and wherein each of the first yarn and the second yarn retain respective yarn attributes for the fibers of the yarn.

In one or more embodiments, the first yarn has a first size and the second yarn has a second size and the first size and the second size are different. The first size may be finer than the second size.

A twist multiplier for one or both of the first and second yarns is maintained in a range of 2.5 to 3.8. A yarn ply twist per inch for one or both of the first and second yarns is maintained between 4 and 7.

In one or more embodiments the plied yarn has a low linting property, with the first yarn being a cotton fiber yarn with an average fiber length in the range of 28-30 mm and the second yarn is a Modal or Lyocell fiber yarn with an average fiber length of 38 mm length.

Another aspect of the present disclosure relates to a method of forming a plied yarn by selecting a first yarn of a first material and first size (length); selecting a second yarn of a second material different from the first material and a second size (length); and combining the first and second yarn to form a plied yarn not intimately blended, wherein the first and second yarn are plied together with a Two For One twister using a doubling process.

The first and second yarn are plied together by maintaining a selected twists per inch, for example, six twists per inch.

In one or more embodiments, the first yarn is a 100% cotton, combed ring spun yarn with a low twist multiplier of 3.3 having approximately 14.5 twists per inch on a 20 S Ne count and the second yarn is manufactured as a separate yarn with an air vortex spinning process and not utilizing traditional blending processes. The second yarn comprises high loft Modal fiber or Lyocell fiber.

In one or more embodiments the first yarn comprises combed cotton.

The first size of the first yarn is different from the second size of the second yarn for varying the percentage (%) of fibers of each of the first yarn and the second yarn in the plied yarn.

The plied yarns according to one or more embodiments described herein may form a terry fabric with the plied yarn for use in towels, robes, apparel, or combinations thereof.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Described herein are yarns developed using a novel method of combining two different yarns, manufactured using different fibers, to produce a yarn having enhanced properties. The yarn(s) can then be used to form various products. The yarns developed and described herein are plied yarns, rather than, and in direct contrast to intimately blended yarns. Examples of the fibers and/or single yarns utilized in forming the plied yarns of different fibers described herein, include but are not limited to 100% Cotton, Modal, and Lyocell. The yarns described herein can be used for various end uses, including but not limited to formation of terry fabric for use in towels, robes, apparel, and the like.

What is meant by "plied" yarn as used throughout this disclosure is a yarn produced by twisting together two or more single yarns. Generally, during plying, the yarns are twisted in the direction opposite to the singles-yarn twist to give a torque-balanced yarn. The plied yarn according to one or more embodiments herein may be a yarn having two plies. However, three or more plies are contemplated and within the scope of this disclosure, the multi-ply plied yarns comprising at least two different construction individual yarns.

In general, there are three (3) types of yarns used in the construction of terry fabric and the pile warp forming loops on the surface of the fabric. The loops can be provided on one or both sides of the fabric. Pile warp is the yarn that is mainly in contact with body or the surface it is used on as this is the soft absorbent side of the fabric. The yarns described herein may be used as a pile warp in forming terry fabric for these various end uses.

Ground warp is the warp yarn running lengthwise on the fabric that is used as the base yarn along with weft to create intersection in the fabric and hold the pile warp yarn in place, preventing pulling of the pile warp yarn by external forces during end use. Ground weft is the weft yarn running across the width of fabric that is used as base yarn along with ground warp to create an intersection in the fabric and hold the pile warp yarn in place from pulling by external forces during end use. Additionally, different yarn can be used to create a border depending on the design needs of the end product. One or more yarns described herein may use for ground warp, ground weft, pile warp, border, and combinations thereof.

Terry fabrics generally have the following properties: high absorbency; quick drying time; low lint shedding; soft hand and high wet strength. Most of these properties are attributed to the pile yarn as this is the exterior surface yarn of the fabric, and thus is visible and can be felt on the surface of the fabric. The pile warp provides comfort and enhances (or controls) user experience. Yarns for pile warps are also created with lower twist to impart softness along with the use of variety of fibers. However other techniques may also used to achieve properties like softness, high absorbency, low linting and quicker drying time.

Cotton is a main component for the pile warp yarn described herein as it provides the above mentioned properties. Additionally, several other fibers like hemp, linen, viscose (from bamboo), silk and man-made natural cellulosic fibers like Lyocell and Modal are also used. Traditionally, intimate blends of the above-mentioned fibers are used to create the pile yarns. However, the yarns and methods of producing the yarns described herein specifically eliminate intimate blending of the single or individual yarns and instead are plied yarns. In some embodiments PVA fibers may also used to create a softer yarn as the PVA fiber dissolves during fabric processing and creates air gaps in the yarn, providing a softer feel.

While one fabric formed by the methods described herein is a terry fabric with end uses including towels (bath towels, kitchen towels, beach towels etc.) and robes, as well as other items general made of a terry fabric, the methods described herein are not so limited to terry fabric.

Methods described herein provide increased flexibility in the manufacturing processes. For example, if the required blend percentage is to be changed for cost or quality concerns, one yarn size can be changed or varied, instead of utilizing the entire spinning process to create a new intimate blend.

The size of the yarn selected is not limited to the sizes described herein and may vary depending on the end of use of the fabric formed. Various combinations of yarn sizes are contemplated and within the scope of this disclosure.

The yarn described herein provides a desired "low linting" property as both fibers, with different lengths, are not intimately blended and will retain their own attributes. Cotton has an average of 28-30 mm length fibers, while Modal is generally 38 mm in length. Modal fibers may last longer, do not shed during exposure to water and abrasion, and withstand repeated wash and dry cycles when compared to cotton fibers.

Both the cotton and Modal, as well as Lyocell yarns may have a longer surface area in the structure of the yarns, providing benefits of both fibers to the yarn when compared to intimate blended yarns, where fibers are intermingled.

Different sizes of cotton yarn and Modal yarn or Lyocell yarn combinations can be plied together depending on the end use of the fabric and/or product needs. Using different yarn sizes will vary the percentage (%) of fibers in a final blend. For example, using finer yarn in 100% cotton in relation to Modal or Lyocell yarn will provide a higher percentage (%) of Modal fiber the final fabric (and vice versa).

The methods described herein also provide more flexibility in manufacturing. If the required blend % is to be changed, for cost or quality purposes, one or both yarns can be changed in size instead of utilizing an entire spinning process to create a new intimate blend.

It is also contemplated that at least one of the single yarns in the plied yarns described herein may be a combed cotton yarn, which according to the methods herein, will provide similar (if not the same) properties of cotton, and the combing adds to the softness of the yarn as short fibers will be removed during the combing process. When the yarn is plied, it will wrap around the Modal yarn leaving a longer surface area for touch and feel as compared to the intimate blend where the fibers are mixed in different proportions and overlap for a shorter span.

In one or more embodiments, Modal fiber utilized for the plied yarn is 2.6 dtex high loft. Deci-tex or "dtex" is a measurement of grams per 10,000 meters of yarn. Dtex is a direct measure of linear density. Such a Modal fiber is coarser (heavier) fiber, with increased cross section, and a 38 mm length. Modal fibers also exhibit a smooth surface and high flexibility and with longer surface area on the structure of yarns, which results in a natural, soft hand feel.

When spun in the yarn, high loft fiber with 2.6 dtex will have a lower number of fibers in a cross section over a 1.3 dtex fiber. In one or more embodiments, this helps to create a more open structure in the yarn, allowing the fabric to achieve other required or desired properties, including one or more of high absorbency, quick drying and low linting.

Single yarns for forming the plied yarns described herein may have the same or different count in the range of 16 S Ne to 30 S Ne.

A twist multiplier for one or both yarns may be maintained in a range of 2.5 to 3.8. A twist multiplier (or "Twist Factor") is an empirical parameter understood in the relevant art that has been established by experiments and practice. The maximum strength of a yarn is obtained for a definite value of the twist multiplier.

A yarn ply twist per inch for one or both yarns may be maintained between 4 and 7. As the yarns are twisted in a reverse direction (Z) to an original twist(S), there is a natural untwisting of both yarns before forming a plied yarn. The number of twists per inch can, in plied yarns, be determined by counting the number of bumps in one inch, and dividing that number by the number of singles (the strands plied together to make the yarn).

Example Yarn One

In one embodiment, a first yarn is manufactured using 100% Cotton, combed ring spun yarn with a low twist multiplier of 3.3 to reach approximately 14.5 twist per inch, on a 20 S Ne (or 20/1) count yarn. A second yarn was manufactured as a separate yarn on a ring spinning process and not utilizing traditional blending processes. The fiber utilizes high loft Modal fiber of 2.6 dtex and 38 mm. Traditionally 2.6 dtex fiber is blended as intimate blend along with cotton in a yarn spinning process for use in towels, and 1.3 dtex Modal fiber is also spun as 100% spun yarns and intimate blended yarns are for use in the apparel industry. The yarn was spun using a twist multiplier of 3 to reach approximately 13.5 twists per inch on a 100% Modal spun yarn of 20 S Ne count yarn. Both of the single yarns, the first yarn and the second yarn have a count size of 20 S Ne.

The first and second yarns are then plied together using a TFO ("Two For One") twist method and/or TFO twist machinery known in the textile industry; using a doubling process, and by maintaining a predetermined number of twists per inch, such as six (6) twists per inch, as a low twist on TFO.

Cotton fiber is shorter in length when compared to Modal fiber. Cotton after a combing process can be between 30 to 32 mm in length, depending on the basis grade used. Modal is a synthetic and machine cut fiber, with a uniform length of 38 mm. During intimate blending, two different lengths of fibers are blended in various ratios such as 1/1 (50% cotton, 50% Modal) or 60/40 cotton/Modal. Cotton is a finer fiber than high loft Modal, and during intimate post combing and blending, the fibers will not be laid in a specific order and thus, the hand-feel and linting properties will vary.

While plying two different yarns according to one or methods described herein, each yarn maintains its own characteristics, and due to plying, have longer and evenly distributed surface area on the face of the yarn. This provides a better hand feel, higher absorbency, and low shedding properties to the yarn and thus the article formed therewith.

Example Yarn Two

In one or more embodiments, a yarn is formed using a non-traditional method of combining two different yarns manufactured using different fibers to achieve a yarn with enhanced properties.

A first yarn is manufactured using traditional 100% cotton combed ring spun yarn with a low twist multiplier of 3.3 to achieve approximately 14.5 twists per inch on a 20 S Ne count yarn.

A second yarn is manufactured as a separate yarn with an air vortex to spin out the yarn (known as VORTEX® spinning). The fiber is high loft Modal fiber of 2.6 dtex and 38 mm. Traditionally 2.6 dtex fiber is blended as an intimate blend along with cotton in a yarn spinning process for use in towels, and 1.3 dtex Modal fiber is also spun as 100% spun yarns and intimate blended yarns for use in the apparel industry.

Both of the first yarn and the second yarn are 20 S Ne count yarn where the first single yarn is 100% combed cotton and the second single yarn is 100% Modal vortex spun yarn.

The 20 S Ne yarn is spun using an air vortex spinning system with a low air flow to retain and/or increase softness of the fiber/yarn. The vortex in the process is a high speed vortex and the process eliminates conventional roving and winding processes, utilizing less energy. As the VORTEX® spinning technology uses an air vortex to spin out the yarn, the yarns formed by these air flows possess a unique structure, and this provides the yarn with a wide range of functionalities and features different from those yarns produced by conventional ring spinning systems.

The method described herein with respect to the Modal fibers and the air vortex spinning possesses various advantages, including reduction in "hairiness" (loose or fringe fibers) and a cleaner or clear appearance; high resistance to pilling and abrasion; high water absorption; less shrinkage and high wash resistance.

The first and second yarns described above are then plied together on the TFO (Two For One) twister using a doubling process and by maintaining six twists per inch as a low twist on TFO.

Example Yarn Three

A first yarn is manufactured using traditional 100% cotton combed ring spun yarn with a low twist multiplier of 3.3 to achieve approximately 14.5 twists per inch on a 20 S Ne count yarn.

A second yarn is manufactured as a separate yarn with the air vortex spinning process and not utilizing traditional blending processes. The fiber used is a Lyocell fiber of 1.3 dtex and 38 mm. Traditionally 1.3 dtex fiber is blended as an intimate blend, along with cotton in yarn spinning processes for use in towels and 1.3 dtex Lyocell fiber is also spun as 100% spun yarns and intimate blended yarns are generally for use in the apparel industry.

The first single yarn is 100% cotton combed with a 20 S Ne size and the second single yarn is 24 S Ne 100% Lyocell vortex spun yarn.

The 20 S NE yarn is spun using the air vortex spinning system with a low air flow to retain/increase softness. The vortex process is a high speed process that eliminates conventional roving and winding processes and utilizes less energy.

Advantages of the second yarn, the Lyocell air vortexed yarn, include a reduced hairiness and clear appearance; higher resistance to pilling and abrasion; high water absorption; reduced shrinking and high wash resistance.

The first and second yarns are then plied together on a TFO (Two For One) twister using a doubling process and by maintaining six twists per inch as a low twist on TFO.

Different sizes of cotton yarn and Lyocell yarn combinations can be plied together depending on the end product needs. Using different yarn sizes will vary the % of fibers in the final blend. For example, using finer yarn in 100% cotton in relation to Lyocell yarn will provide a higher % of Lyocell fiber the final fabric (and vice versa).

Combed cotton yarn will provide the standard properties of cotton, and being combed will add to the softness of the yarn as short fibers will be removed during the combing process. When the yarn is plied it will wrap around the Lyocell yarn leaving a longer surface area for better touch and feel as compared to the intimate blend where the fibers are mixed in different proportions and overlap for a shorter span. Lyocell fibers are naturally soft to touch and offer long lasting comfort. Through moisture management, Lyocell fibers absorb moisture efficiently. The second yarn comprising the Lyocell fibers is 1.3 dtx. The Lyocell fibers also exhibit a smooth surface and high flexibility and with a longer surface area on the structure of yarns, which will result in natural soft hand feel to the plied yarn.

The plied yarn described herein provides desired "low linting" properties as both fibers with different lengths (e.g., Cotton averages 28-30 mm length, Lyocell averages 38 mm length) are not intimately blended and will retain their own yarn attributes.

The Lyocell fibers also last longer, do not shed during exposure to water and abrasion, and withstand repeated wash and dry cycles compared to cotton. In the plied yarn, both the cotton and Lyocell yarns have a longer surface area in the structure of the yarns, providing the benefits of both Cotton and Lyocell fibers in the plied yarn, as compared to intimate blended yarns where the fibers are intermingled.

Technical Advantages of Plied Yarn Over Intimately Blended Yarn

Cotton fiber is shorter in length compared to Lyocell. Cotton after a combing process can be between 30 to 32 mm length depending on the basis grade used. Lyocell is a man made and machine cut fiber with a uniform length of 38 mm. During intimate blending, two different lengths of fibers are blended in various ratios, such as 50/50 cotton/Lyocell or 60/40 cotton/Lyocell. Being a natural fiber, cotton fiber fineness will vary more than Lyocell and during intimate post combing blending, the fibers will not be laid in a specific order. The hand feel and linting properties will also vary.

While plying two different yarns, each yarn maintains its characteristics and due to plying have longer and evenly distributed surface area on the face of the yarn proving better hand feel, absorbency, and low shedding properties.

In one or more embodiments described herein, both the fibers used in production of the yarns described herein are bio-degradable under specific conditions and do not have known any adverse environmental impacts. Cotton is a natural fiber, and Modal is produced from FSC certified wood, using a closed loop process to recover solvents with no toxic chemical discharge as compared to other man-made or synthetic cellulosic fibers such as viscose, rayon or viscose from bamboo fibers. Lyocell is formed from FSC certified wood, using a closed loop process to recover solvents with no toxic chemical discharge as compared to other man-made or synthetic cellulosic fibers like viscose, rayon or viscose from bamboo fibers. The Lyocell fibers described herein have also been certified as Biobased by the USDA.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A plied yarn formed with two different yarns, wherein a first yarn comprises 100% cotton or combed cotton fibers, and a second yarn comprises Modal or Lyocell fibers and wherein the first yarn and the second yarn are plied and are not intimately blended, and wherein each of the first yarn and the second yarn retain respective yarn characteristics for the fibers of the yarn, and wherein a twist multiplier for one or both of the first and second yarns is maintained in a range of 2.5 to 3.8.

2. The plied yarn of claim 1 wherein the first yarn has a first size and the second yarn has a second size and the first size and the second size are different.

3. The plied yarn of claim 2 wherein the first size is finer than the second size.

4. The plied yarn of claim 1 wherein a yarn ply twist per inch for one or both of the first and second yarns is maintained between 4 and 7.

5. The plied yarn of claim 1 wherein each of the first yarn and the second yarn have the same or different count wherein the count is in the range of 16 S Ne to 30 S Ne.

6. The plied yarn of claim 1 and having a low linting property with each of the first yarn and the second yarn comprising fibers with different lengths, wherein the first yarn is a cotton fiber yarn with an average fiber length in the range of 28-30 mm and the second yarn is a Modal or Lyocell fiber yarn with an average fiber length of 38 mm length.

7. The plied yarn of claim 1 wherein the plied yarn is a pile warp yarn for forming a terry fabric.

8. A method of forming a plied yarn, the method comprising:

selecting a first yarn of a first material and first size;

selecting a second yarn of a second material different from the first material and a second size, wherein the first size, different from the second size, is finer than the second size; and combining the first and second yarn to form a plied yarn not intimately blended, wherein the first and second yarn are plied together with a Two For One twister using a doubling process, wherein each of the first yarn and the second yarn have the same or different count where the count is in the range of 16 S Ne to 30 S Ne.

9. The method of claim 8 wherein the first and second yarn are plied together by maintaining six twists per inch.

10. The method of claim 8 wherein the first yarn is a 100% cotton, combed ring spun yarn with a low twist multiplier of 3.3 having approximately 14.5 twists per inch on a 20 S Ne count.

11. The method of claim 8 wherein the second yarn is manufactured as a separate yarn with an air vortex spinning process.

12. The method of claim 10 wherein the second yarn comprises high loft Modal fiber.

13. The method of claim 10 wherein the second yarn comprises Lyocell fiber.

14. The method of claim 10 wherein the first yarn comprises combed cotton.

15. A plied yarn formed with two different yarns, wherein the first yarn and the second yarn are plied and are not intimately blended, and wherein each of the first yarn and the second yarn retain respective yarn characteristics for the fibers of the yarn and wherein the first yarn comprises 100% cotton or combed cotton fibers and has a first size and the second yarn comprises Modal or Lyocell fibers and has a second size, and the first size and the second size are different and the first size is finer than the second size.

16. The plied yarn of claim 15 and having a low linting property with each of the first yarn and the second yarn comprising fibers with different lengths, wherein the first yarn has an average fiber length in the range of 28-30 mm and the second yarn has an average fiber length of 38 mm length.

* * * * *